US009910376B1

(12) United States Patent
Ashley et al.

(10) Patent No.: US 9,910,376 B1
(45) Date of Patent: Mar. 6, 2018

(54) TONER FORMULATION HAVING A SILANE SURFACE TREATED ON ITS OUTER SURFACE AND METHOD OF PREPARING THE SAME

(71) Applicant: LEXMARK INTERNATIONAL, INC., Lexington, KY (US)

(72) Inventors: Danielle Renee Ashley, Longmont, CO (US); Ligia Aura Bejat, Lexington, KY (US); Michael James Bensing, Lexington, KY (US); Ashley Schafer Grant, Lexington, KY (US); Cory Nathan Hammond, Winchester, KY (US); Rick Owen Jones, Berthoud, CO (US); John Joseph Kraseski, Lexington, KY (US); Jing X Sun, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/355,670

(22) Filed: Nov. 18, 2016

(51) Int. Cl.

| | |
|---|---|
| ***G03G 9/093*** | (2006.01) |
| ***G03G 9/08*** | (2006.01) |
| ***G03G 9/087*** | (2006.01) |

(52) U.S. Cl.
CPC ..... *G03G 9/09328* (2013.01); *G03G 9/0819* (2013.01); *G03G 9/0827* (2013.01); *G03G 9/08711* (2013.01); *G03G 9/08755* (2013.01); *G03G 9/09307* (2013.01); *G03G 9/09321* (2013.01); *G03G 9/09335* (2013.01); *G03G 9/09342* (2013.01); *G03G 9/09364* (2013.01); *G03G 9/09371* (2013.01); *G03G 9/09392* (2013.01)

(58) Field of Classification Search
CPC ..... G03G 9/09328; G03G 9/09371; G03G 9/09342; G03G 9/09335; G03G 9/09307; G03G 9/09314; G03G 9/09392; G03G 9/09321; G03G 9/09364
USPC ..... 430/110.2, 108.3, 137.11
See application file for complete search history.

(56) References Cited

U.S. PATENT DOCUMENTS

| | | | | |
|---|---|---|---|---|
| 5,215,855 | A * | 6/1993 | Keoshkerian ..... | G03G 9/09328 430/124.31 |
| 9,023,569 | B2 * | 5/2015 | Sun ..... | G03G 9/09328 430/108.1 |
| 2015/0370182 | A1 * | 12/2015 | Ikarashi ..... | C08J 7/042 428/327 |

OTHER PUBLICATIONS

Grant et al., ed., Grant & Hackh's Chemical Dictionary, fifth edition (1987), NY, MacGraw-Hill Book Company, p. 293.*

* cited by examiner

*Primary Examiner* — Janis L Dote

(57) ABSTRACT

A chemically prepared toner composition according to one example embodiment includes a core including a first polymer binder, a colorant and a release agent; a shell that is formed around the core that includes a second polymer binder; and a borax coupling agent between the core and the shell and an alkoxysilane hydrocarbon or combination of different alkoxysilane hydrocarbons that are bonded to the outer surface of the shell using a hydrolytic deposition process. This successful alkoxysilane hydrocarbon surface treatment on the outer surface of the toner particle results in attaining a desirable charge stability in hot and humid environments and ultimately improving the quality of the toner, especially by reducing toner dusting, toner fuming and ultra-fine particles generation.

4 Claims, No Drawings

TONER FORMULATION HAVING A SILANE SURFACE TREATED ON ITS OUTER SURFACE AND METHOD OF PREPARING THE SAME

CROSS REFERENCES TO RELATED APPLICATIONS

None.

BACKGROUND

Field of the Disclosure

The present invention relates generally to chemically prepared toners for use in electrophotography and more particularly to a formulation and method for preparing a chemically prepared toner wherein a silane is surface treated on the outer surface of the core shell toner. The silane is surface treated on the outer surface of the toner using a sol-gel technique in situ, in particular a hydrolytic deposition process. This silane surface treatment on the outer surface of the toner changes the surface energy of the toner thereby generating an improved toner, particularly at hot and high humidity environments.

Description of the Related Art

Toners for use in electrophotographic printers include two primary types, mechanically milled toners and chemically prepared toners (CPT). Chemically prepared toners have significant advantages over mechanically milled toners including better print quality, higher toner transfer efficiency and lower torque properties for various components of the electrophotographic printer such as a developer roller, a fuser belt and a charge roller. The particle size distribution of CPTs is typically narrower than the particle size distribution of mechanically milled toners. The size and shape of CPTs are also easier to control than mechanically milled toners.

One process for preparing a CPT is by emulsion aggregation. Emulsion aggregation is carried out in an aqueous system resulting in good control of both the size and shape of the toner particles. The toner components typically include a polymer binder, one or more colorants and a release agent.

Electrophotographic printers typically use either a single component or a dual component development system. In a dual component development system, magnetic particles, or carriers, typically based on a manganese-ferrite core are combined with toner particles in what is called a developer mix. The magnetic particles are also used to charge the toner particles in a triboelectric manner. The normal triboelectric charge exchange between toner particles and the magnetic carriers is moderated by the moisture content in air. Thus, one measure of toner or developer mix performance is its ability to exhibit excellent charge stability and in particular exhibit charge stability in high temperatures and high humidity environments.

Additionally, toner charge can diminish when the developer mix is not being stirred in a toner reservoir, due to charge exchange (i.e. neutralization or "relaxation") between the toner particles and carrier while at rest. If the charge is not maintained at an adequate level, the toner particles can no longer be contained in toner reservoir due to the forces normally applied by electric fields. Under the influence of these forces, the toner exits in a cloud of toner particles suspended in air, commonly referred to as toner fuming or toner dusting. Toner dusting and fuming negatively effects print quality.

The inventors of the present invention have discovered that by surface treating and bonding the outer surface of the toner particle with certain hydrocarbonsilane or a combination of hydrocarbonsilanes, the surface energy of the toner can be changed. This change in the toner's surface energy positively affects the charge stability of the toner, particularly at hot and high humidity environments. However to successfully change the surface energy of the toner particle, this silane must bond on the outer surface of the toner shell resin and cannot be embedded inside the outer shell resin of the toner. Unfortunately many surface treatments result in the embedding of the silane into the toner's shell, thereby negating any positive effect from the silane surface treatment. Moreover, it is difficult to bond a silane onto the outer surface of the toner particle through direct interaction such as Van der Waals forces, because the hydrophobicity of the hydrocarbonsilane used as a successful surface treatment in this invention is different from the hydrophobicity of the functional groups found on the toner's surface. The inventors have found that by using a the sol-gel technique in situ, in particular a hydrolytic deposition process as the surface treatment, an alkyloxysilane can be used to interact with the functional groups found on the outer surface of the toner particle via the hydrolytic deposition. Hydrolytic deposition efficiently decreases the hydrophilicity of the toner surface, promotes the interacting and eventual bonding of the alkyloxysilane with the functional groups found on the outer surface of the toner. Exemplary alkyloxysilane include trialkoxysilanehydrocarbon, dialkoxysilanehydrocarbon, monoalkoxysilanehydrocarbon, tetraalkoxydisiloxanehydrocarbon, tetraalkyldisiloxanehydrocarbon and tri siloxanehydrocarbon. Exemplary functional groups located on the outer surface of the toner particle include carboxyl and hydroxyl groups. This successful silane surface treatment on the outer surface of the toner particle results in attaining a desirable charge stability in hot and humid environments and ultimately improving the quality of the toner, especially by reducing toner dusting, toner fuming and ultra-fine particles generation.

SUMMARY

A method for producing toner for electrophotography according to one embodiment, includes surface treating the outer surface of a core shell toner particle with a silane or combination of different silanes using a hydrolytic deposition process after the core shell toner particle is fully formed. This particular method results in the bonding of the silane or combination of silanes to the outer surface of the core shell toner particle. In particular, a first and a second polymer emulsion are separately prepared as well as a pigment dispersion and wax dispersion. Additionally the chosen silane or combination of different silanes are dissolved in alcohol to form a silane solution. The first polymer emulsion is then combined and agglomerated with the pigment and wax dispersion to form toner cores. An optional borax coupling agent is added to the toner cores once the toner cores reach a predetermined size. The second polymer emulsion is combined and agglomerated with the toner cores to form toner shells around the toner cores. The toner cores and toner shells are then fused to form toner particles. The silane solution is added dropwise to the fully formed core shell toner mixture and well stirred overnight, resulting in a silane surface treated core shell toner. This silane surface treated toner is then filtered, washed and dried. In an alternative method, the outer surface of the toner is surface treated with the silane solution and then fused to form toner particles. The silane surface treated core shell toner may then be mixed with magnetic carrier beads to form a developer mix to be used in a dual component development electrophotographic printer.

A chemically prepared toner composition, according to one example embodiment includes a toner particle having a core including a first polymer binder, a pigment, and a release agent, and a shell formed around the core and a silane or combination of different silanes are bonded to the outer surface of the shell using a hydrolytic deposition process. An optional borax coupling agent can be placed between the outer surface of the core and the shell to assist in the binding of the polymer found in the shell onto the surface of the toner core containing the first polymer.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

The present disclosure relates to a chemically prepared core shell toner surface treated with a silane compounds and an associated method of preparation of the toner. The silane or combination of silanes are bonded onto the outer surface of the toner particle using a hydrolytic deposition process. The silane or combination of different silanes chemically interact with functional groups found on the outer surface of the toner particle. This chemical interaction modifies the surface of the toner and changing the toner's surface energy. This change in surface energy positively affects the charge stability of the toner and reduces toner dust generation, especially in hot and humid temperature environments. The toner is utilized in an electrophotographic printer such as a printer, copier, multi-function device or an all-in-one device. The electrophotographic printer can be either a monocomponent development (MCD) printer or a dual component development (DCD) printer. The toner is provided in a cartridge that supplies toner to the electrophotographic printer. Example methods of forming toner using emulsion aggregation techniques are found in U.S. Pat. Nos. 6,531,254 and 6,531,256, which are incorporated by reference herein in their entirety. Additionally, U.S. Pat. Nos. 8,669,035 and 9,023,569 disclose example toner formulations and methods of making toner using a borax coupling agent and are assigned to the applicants of the present invention and are incorporated by reference herein in their entirety.

In the present emulsion aggregation process, the toner particles are manufactured by chemical methods as opposed to physical methods such as pulverization. Generally, the toner includes one or more polymer binders, a core shell latex, a release agent or wax, a colorant, an optional borax coupling agent and one or more optional additives such as a charge control agent (CCA).

A detailed synthesis of the toner of the present invention is set forth as follows: An emulsion of a polymer binder is formed in water, optionally with organic solvent, with an inorganic base such as sodium hydroxide, potassium hydroxide, ammonium hydroxide, or an organic amine compound. A stabilizing agent having an anionic functional group (A−), e.g., an anionic surfactant or an anionic polymeric dispersant may also be included. It will be appreciated that a cationic (C+) functional group, e.g., a cationic surfactant or a cationic polymeric dispersant, may be substituted as desired. The polymer latex is used at two points during the toner formation process. A first portion of the polymer latex is used to form the core of the resulting toner particle and a second portion of the polymer latex is used to form a shell around the toner core. The first and second portions of the polymer latex may be formed separately or together. Where the portions of the polymer latex forming the toner core and the toner shell are formed separately, either the same or different polymer binders may be used in the core and shell. In the emulsion aggregation toner, different polymer latexes are used for the core and shell of the toner. The ratio of the amount of polyester binder in the toner core to the amount of polyester binder in the shell is between about 20:80 (wt.) and about 80:20 (wt.) including all values and increments therebetween, such as between about 50:50 (wt.) and about 80:20 (wt.), depending on the particular polyester resin(s) used.

The core shell polymer latex, colorant, release agent and the optional CCA are dispersed separately in their own aqueous environments or in one aqueous mixture, as desired, in the presence of a stabilizing agent having similar functionality (and ionic charge) as the stabilizing agent employed in the polymer latex. Separately a solution containing a silane or a combination of silanes are dissolved in alcohol. The polymer latex forming the toner core, the colorant dispersion, the release agent dispersion and the optional CCA dispersion are then mixed and stirred to ensure a homogenous composition. As used herein, the term dispersion refers to a system in which particles are dispersed in a continuous phase of a different composition (or state) and may include an emulsion. Acid is then added to reduce the pH and cause flocculation. In this case, flocculation includes the formation of a gel where resin, colorant, release agent and CCA form an aggregate mixture, typically from particles 1-2 microns (μm) in size. Unless stated otherwise, reference to particle size herein refers to the largest cross-sectional dimension of the particle. The aggregated toner particles may then be heated to a temperature that is 5° to 15° below the glass transition temperature (Tg) of the polymer latex to induce the growth of clusters of the aggregate particles. Once the aggregate particles reach the desired size of the toner core, the borax coupling agent is added so that it forms on the surface of the toner core. Following addition of the borax coupling agent, the polymer latex forming the toner shell is added. This polymer latex aggregates around the toner core to form the toner shell. Once the aggregate particles reach the desired toner size, base may be added to increase the pH and reionize the anionic stabilizing agent to prevent further particle growth or one can add additional anionic stabilizing agents. The temperature is then raised above the glass transition temperature of the polymer latex(es) to fuse the particles together within each cluster. This temperature is maintained until the particles reach the desired shape and circularity. The heating is stopped. The silane solution is then added dropwise to the reactor and stirred overnight. The final toner is filtered, washed and dried.

Alternatively, the silane solution can be added after the toner particle is formed but before fusing. After the addition of the silane solution, the temperature of the reactor is then raised above the glass transition temperature of the polymer latex(es) to fuse the particles together within each cluster. This temperature is maintained until the particles reach the desired circularity. The toner particles are then washed and dried.

The toner particles produced may have an average particle size of between about 3 μm and about 20 μm (volume average particle size) including all values and increments therebetween, such as between about 4 μm and about 15 μm or, more particularly, between about 5 μm and about 7 μm. The toner particles produced may have an average degree of circularity between about 0.90 and about 1.00, including all values and increments therebetween, such as about 0.93 to about 0.98. The average degree of circularity and average particle size may be determined by a Sysmex Flow Particle Image Analyzer (e.g., FPIA-3000) available from Malvern Instruments, Ltd., Malvern, Worcestershire, UK. Average particle size may be measured using a Beckman Multisizer 111.

The various components for the emulsion aggregation method to prepare the above referenced toner will be described below. It should be noted that the various features of the indicated components may all be adjusted to facilitate the step of aggregation and formation of toner particles of desired size and geometry. It may therefore be appreciated that by controlling the indicated characteristics, one may first form relatively stable dispersions, wherein aggregation may proceed along with relatively easy control of final toner particle size for use in an electrophotographic printer or printer cartridge.

As mentioned above, the toners herein include one or more polymer binders. The terms resin and polymer are used interchangeably herein as there is no technical difference between the two. In one embodiment, the polymer binder(s) include polyesters. The polyester binder(s) may include a semi-crystalline polyester binder, a crystalline polyester binder or an amorphous polyester binder. Alternatively, the polyester binder(s) may include a polyester copolymer binder resin. For example, the polyester binder(s) may include a styrene/acrylic-polyester graft copolymer. The polyester binder(s) may be formed using acid monomers such as terephthalic acid, trimellitic anhydride, dodecenyl succinic anhydride and fumaric acid. Further, the polyester binder(s) may be formed using alcohol monomers such as ethoxylated and propoxylated bisphenol A. Example polyester resins include, but are not limited to, T100, TF-104, NE-1582, NE-701, NE-2141, NE-1569, Binder C, FPESL-2, W-85N, TL-17, TPESL and TPESM series of polyester resins from Kao Corporation, Bunka Sumida-ku, Tokyo, Japan, or mixtures thereof. The polymer binder(s) also includes a thermoplastic type polymer such as a styrene and/or substituted styrene polymer, such as a homopolymer (e.g., polystyrene) and/or copolymer (e.g., styrene-butadiene copolymer and/or styrene-acrylic copolymer, a styrene-butyl methacrylate copolymer and/or polymers made from styrene-butyl acrylate and other acrylic monomers such as hydroxy acrylates or hydroxyl methacrylates); polyvinyl acetate, polyalkenes, poly(vinyl chloride), polyurethanes, polyamides, silicones, epoxy resins, or phenolic resins. Various commercially available crystalline polyester resin emulsions are available from Kao Corporation, Bunka Sumida-ku, Tokyo, Japan and Reichhold Chemical Company, Durham, N.C. under the trade names EPC 2-20, EPC 3-20, 6-20, 7-20, CPES B1, EPC 8-20, EPC 9-20, EPC-10-20, CPES B20 and CPES B25.

Colorants are compositions that impart color or other visual effects to the toner and may include carbon black, dyes (which may be soluble in a given medium and capable of precipitation), pigments (which may be insoluble in a given medium) or a combination of the two. A colorant dispersion may be prepared by mixing the pigment in water with a dispersant. Alternatively, a self-dispersing colorant may be used thereby permitting omission of the dispersant. The colorant may be present in the dispersion at a level of about 5% to about 20% by weight including all values and increments therebetween. For example, the colorant may be present in the dispersion at a level of about 10% to about 15% by weight. The dispersion of colorant may contain particles at a size of about 50 nanometers (nm) to about 500 nm including all values and increments therebetween. Further, the colorant dispersion may have a pigment weight percent divided by dispersant weight percent (P/D ratio) of about 1:1 to about 8:1 including all values and increments therebetween, such as about 2:1 to about 5:1. The colorant may be present at less than or equal to about 15% by weight of the final toner formulation including all values and increments therebetween.

The optional coupling agent used herein is borax (also known as sodium borate, sodium tetraborate, or disodium tetraborate). As used herein, the term borax coupling agent is defined as enabling the formation of hydrogen bonds between polymer chains which assists in the anchoring or binding of the polymer found in the shell onto the surface of the toner core containing the polymers or mixture of polymers, thereby helping to couple the shell to the outer surface of the toner core. The borax coupling agent bonds the shell to the outer surface of the core by forming hydrogen bonding between its hydroxyl groups and the functional groups present in the polymers utilized in the inventive toner formulation.

Coupling agents have multivalent bonding ability. Borax differs from commonly used permanent coupling agents, such as multivalent metal ions (e.g., aluminum and zinc), in that its bonding is reversible. In the electrophotographic process, toner is preferred to have a low fusing temperature to save energy and a low melt viscosity ("soft") to permit high speed printing at low fusing temperatures. However, in order to maintain the stability of the toner during shipping and storage and to prevent filming of the printer components, toner is preferred to be "harder" at temperatures below the fusing temperature. Borax provides cross-linking through hydrogen bonding between its hydroxy groups and the functional groups of the molecules it is bonded to. The hydrogen bonding is sensitive to temperature and pressure and is not a stable and permanent bond. For example, when the temperature is increased to a certain degree or stress is applied to the polymer, the bond will partially or completely break causing the polymer to "flow" or tear off. The reversibility of the bonds formed by the borax coupling agent is particularly useful in toner because it permits a "soft" toner at the fusing temperature but a "hard" toner at the storage temperature. The reversible borax coupling agent may be present in the range of about 0.1% to about 5.0% by weight of the total polymer binder in the toner including all values and increments therebetween, such as between 0.1% and 1.0%.

The silane compounds used herein as surface treatments are organosilanes, in particular an alkoxysilane or siloxane is necessary to initiate the hydrolytic reaction with the functional groups on the toner surface. The hydrolytic deposition anchors the attachment of the hydrocarbonsilane to the outer surface of the toner. Through the alkoxy groups covalently bonded to the functional groups located on the surface of the toner particle, hydrocarbonsilanes interact with the outer surface of the toner to decrease the hydrophilicity of the toner and firmly bonds onto the outer surface of the toner. The hydrocarbon group thus modifies the properties of the toner particle surface including, but not limited to, hydrophobicity, charge stability, surface energy, dielectric properties, and absorption properties. Both of the alkoxy and hydrocarbon functional groups can also exist in one molecule and function as the hydrolytic deposition and hydrophobicity modification on the toner surface.

Silanes may be selected from a group including, but not limited to, methoxysilanes, ethoxysilanes, siloxanes, disiloxanes, trisiloxanes, trimethoxysilanehydrocarbons, dimethoxysilanehydrocarbons, monomethoxysilanehydrocarbons, diethoxysilanehydrocarbon, triethoxysilanehydrocarbons, monoethoxysilanehydrocarbons, tetraalkoxydisiloxanehydrocarbons and tetraalkylldisiloxanehydrocarbons. Although longer chain length silanes are preferred to facilitate the strong interaction and bonding with the toner surface, the chain length must not be too long because longer chain lengths are difficult to disperse in aqueous system and therefore will negatively increase the toner processing. Exemplary silanes used have a chain length between 8 and 18 carbons. An embodiment uses a combination of 1,3-di-n-octyltetramethyldisiloxane and diethoxydimethylsilane for the chosen combination of silanes to be surface treated on the outer surface of the toner particle using a hydrolytic deposition process. Alternative embodiments use a silane such as n-octyltrimethoxysilane, n-octyltriethoxysilane, or n-octadecyltrimethoxysilane, n-octadecyltriethoxysilane. diethoxydimethylsilane, and diethoxydiethylsilane either alone or in combination as the chosen silane to be surface treated on the outer surface of the toner particle. Useful commercially available silanes having a chain length of between 8 and 18 carbons are available from Gelest, Inc., Morrisville, Pa. The silane may be present in the range of about 0.1% to about 2% by weight of the resin including all values and increments therebetween, such as between 0.1% and 2%.

The release agent used may include any compound that facilitates the release of toner from a component in an electrophotographic printer (e.g., release from a roller surface). The term 'release agent' can also be used to describe a compound that facilitates the release of toner from a component in an electrophotographic printer. For example, the release agent or wax may include polyolefin wax, ester wax, polyester wax, polyethylene wax, metal salts of fatty acids, fatty acid esters, partially saponified fatty acid esters, higher fatty acid esters, higher alcohols, paraffin wax, carnauba wax, amide waxes and polyhydric alcohol esters or mixtures thereof.

The release agent may therefore include a low molecular weight hydrocarbon based polymer (e.g., Mn≤10,000) having a melting point of less than about 140° C. including all values and increments between about 50° C. and about 140° C. The wax may be present in the dispersion at an amount of about 5% to about 40% by weight including all values and increments there between. For example, the wax may be present in the dispersion at an amount of about 10% to about 18% by weight. The wax dispersion may also contain particles at a size of about 50 nm to about 1 μm including all values and increments there between. In addition, the wax dispersion may be further characterized as having a wax weight percent divided by dispersant weight percent (RA/D ratio) of about 1:1 to about 35:1. For example, the RA/D ratio may be about 3:1 to about 8:1. The wax is provided in the range of about 2% to about 20% by weight of the final toner formulation including all values and increments there between. Exemplary waxes having these above enumerated characteristics include, but are not limited to, SD-A01, SD-B01, MPA-A02, CM-A01 and CM-B01 from Cytech Products, Inc., Polywax M70, Polywax M80 and Polywax 500 from Baker Hughes and WE5 from Nippon Oil and Fat.

A surfactant, a polymeric dispersant or a combination thereof may be used. The polymeric dispersant may generally include three components, namely, a hydrophilic component, a hydrophobic component and a protective colloid component. Reference to hydrophobic refers to a relatively non-polar type chemical structure that tends to self-associate in the presence of water. The hydrophobic component of the polymeric dispersant may include electron-rich functional groups or long chain hydrocarbons. Such functional groups are known to exhibit strong interaction and/or adsorption properties with respect to particle surfaces such as the colorant and the polyester binder resin of the polyester resin emulsion. Hydrophilic functionality refers to relatively polar functionality (e.g., an anionic group) which may then tend to associate with water molecules. The protective colloid component includes a water soluble group with no ionic function. The protective colloid component of the polymeric dispersant provides extra stability in addition to the hydrophilic component in an aqueous system. Use of the protective colloid component substantially reduces the amount of the ionic monomer segment or the hydrophilic component in the polymeric dispersant. Further, the protective colloid component stabilizes the polymeric dispersant in lower acidic media. The protective colloid component generally includes polyethylene glycol (PEG) groups. The dispersant employed herein may include the dispersants disclosed in U.S. Pat. No. 6,991,884 and U.S. Pat. No. 5,714,538, which are assigned to the assignee of the present application and are incorporated by reference herein in their entirety.

The surfactant, as used herein, may be a conventional surfactant known in the art for dispersing non self-dispersing colorants and release agents employed for preparing toner formulations for electrophotography. Commercial surfactants such as the AKYPO series of carboxylic acids from AKYPO from Kao Corporation, Bunka Sumida-ku, Tokyo, Japan may be used. For example, alkyl ether carboxylates and alkyl ether sulfates, preferably lauryl ether carboxylates and lauryl ether sulfates, respectively, may be used. One particular suitable anionic surfactant is AKYPO RLM-100 available from Kao Corporation, Bunka Sumida-ku, Tokyo, Japan, which is laureth-11 carboxylic acid thereby providing anionic carboxylate functionality. Other anionic surfactants contemplated herein include alkyl phosphates, alkyl sulfonates and alkyl benzene sulfonates. Sulfonic acid containing polymers or surfactants may also be employed.

The toner formulation of the present disclosure may also include one or more conventional charge control agents, which may optionally be used for preparing the toner formulation. A charge control agent may be understood as a compound that assists in the production and stability of a tribocharge in the toner. The charge control agent(s) also help in preventing deterioration of charge properties of the toner formulation. The charge control agent(s) may be prepared in the form of a dispersion in a manner similar to that of the colorant and release agent dispersions discussed above.

The toner formulation may include one or more additional additives, such as acids and/or bases, emulsifiers, extra particular additives, UV absorbers, fluorescent additives, pearlescent additives, plasticizers and combinations thereof. These additives may be desired to enhance the properties of an image printed using the present toner formulation. For example, UV absorbers may be included to increase UV light fade resistance by preventing gradual fading of the image upon subsequent exposures to ultraviolet radiations. Suitable examples of the UV absorbers include, but are not limited to, benzophenone, benzotriazole, acetanilide, triazine and derivatives thereof.

The following examples are provided to further illustrate the teachings of the present disclosure, not to limit the scope of the present disclosure.

Preparation of Example Cyan Pigment Dispersion

About 10 g of AKYPO RLM-100 polyoxyethylene(10) lauryl ether carboxylic acid from Kao Corporation, Bunka Sumida-ku, Tokyo, Japan was combined with about 350 g of de-ionized water and the pH was adjusted to ~7-9 using sodium hydroxide. About 10 g of Solsperse 27000 from Lubrizol Advanced Materials, Cleveland, Ohio, USA was added and the dispersant and water mixture was blended with an electrical stirrer followed by the relatively slow addition of 100 g of pigment blue 15:3. Once the pigment was completely wetted and dispersed, the mixture was added to a horizontal media mill to reduce the particle size. The solution was processed in the media mill until the particle size was about 200 nm. The final pigment dispersion was set to contain about 20% to about 25% solids by weight.

Preparation of Example Wax Emulsion

About 12 g of AKYPO RLM-100 polyoxyethylene(10) lauryl ether carboxylic acid from Kao Corporation, Bunka Sumida-ku, Tokyo, Japan was combined with about 325 g of de-ionized water and the pH was adjusted to ~7-9 using sodium hydroxide. The mixture was then processed through a microfluidizer and heated to about 90° C. About 60 g of polyethylene wax from Baker Hughes, Houston, Tex. was slowly added to the hot mixture while the temperature was maintained at about 90° C. for about 15 minutes. The emulsion was then removed from the microfluidizer when the particle size was below about 300 nm. The solution was then stirred at room temperature. The wax emulsion was set to contain about 10% to about 18% solids by weight Preparation of Example Polyester Resin Emulsion A A polyester resin having a peak molecular weight of about 11,000, a glass transition temperature (Tg) of about 55° C. to about 58° C., a melt temperature (Tm) of about 115° C., and an acid value of about 8 to about 13 was used. The glass transition temperature is measured by differential scanning calorimetry (DSC), wherein, in this case, the onset of the shift in baseline (heat capacity) thereby indicates that the Tg may occur at about 55° C. to about 58° C. at a heating rate of about 5 per minute. The acid value may be due to the presence of one or more free carboxylic acid functionalities (—COOH) in the polyester. Acid value refers to the mass of potassium hydroxide (KOH) in milligrams that is required to neutralize one gram of the polyester. The acid value is therefore a measure of the amount of carboxylic acid groups in the polyester.

150 g of the polyester resin was dissolved in 450 g of methyl ethyl ketone (MEK) in a round bottom flask with stirring. The dissolved resin was then poured into a beaker. The beaker was placed in an ice bath directly under a homogenizer. The homogenizer was turned on at high shear and 7 g of 10% potassium hydroxide (KOH) solution and 500 g of de-ionized water were immediately added to the beaker. The homogenizer was run at high shear for about 2-4 minutes then the homogenized resin solution was placed in a vacuum distillation reactor. The reactor temperature was maintained at about 43° C. and the pressure was maintained between about 22 inHg and about 23 inHg. About 500 mL of additional de-ionized water was added to the reactor and the temperature was gradually increased to about 70° C. to ensure that substantially all of the MEK was distilled out. The heat to the reactor was then turned off and the mixture was stirred until it reached room temperature. Once the reactor reached room temperature, the vacuum was turned off and the resin solution was removed and placed in storage bottles.

The particle size of Polyester Resin Emulsion A was between about 190 nm and about 240 nm (volume average) as measured by a NANOTRAC Particle Size Analyzer. The pH of the resin solution was between about 7.5 and about 8.2.

Preparation of Example Polyester Resin Emulsion B

A polyester resin having a peak molecular weight of about 13K, a glass transition temperature of about 58° C. to about 62° C., a melt temperature of about 110° C., and an acid value of about 20 to 23 was used to form an emulsion using the procedure outlined above to make example Polyester Resin Emulsion A except using about 10 g of the 10% potassium hydroxide (KOH) solution.

The particle size of Polyester Resin Emulsion B was between about 190 nm and about 240 nm (volume average) as measured by a NANOTRAC Particle Size Analyzer. The pH of the resin solution was between about 6.5 and about 7.0.

Toner Formulation Examples

Example Toner A

The Example Polyester Resin Emulsion A and the Example Polyester Resin Emulsion B are used in a core to shell ratio of 65:35 (wt.). Components were added to a 2.0 liter reactor in the following relative proportions: 538 g (29.75%) of the Example Polyester Resin Emulsion A, 60.5 g (29.17%) of the Example Cyan Pigment Dispersion, 98 g (35%) of the Example Wax Emulsion. Deionized water was then added so that the mixture contained about 12% to about 15% solids by weight.

The mixture was heated in the reactor to 25° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 210 g of 1% sulfuric acid solution. The flow of the loop was then reversed to return the toner mixture to the reactor and the temperature of the reactor was increased to about 40-45° C. Once the particle size reached 4.05 μm to 4.5 μm (number average), 5% (wt.) borax solution (20 g of solution having 1.0 g of borax) was added. After the addition of borax, 290 g (29.75%) of the Example Polyester Resin Emulsion B was added to form the shell. The mixture was stirred for about 5 minutes and the pH was monitored. Once the particle size reached 5.5 μm (number average), 4% NaOH was added to raise the pH to about 6.89 to stop the particle growth. The reaction temperature was held for one hour. The temperature was increased to 82° C. to cause the particles to coalesce. This temperature was maintained until the particles reached their desired circularity (about 0.972). The heating of the reactor was stopped and a solution of 0.24 g diethoxydimethylsilane, 1.23 g 1,3-di-n-octyltetramethyldisiloxane and 10 ml of methanol was added dropwise in the reactor. The mixture was stirred overnight and filtered. The toner was then washed and dried.

The dried toner had a volume average particle size of 6.84 μm, measured by a COULTER COUNTER Multisizer 3 analyzer and a number average particle size of 5.63 μm. Fines (<2 μm) were present at 1.50% (by number) and the toner possessed a circularity of 0.972, both measured by the SYSMEX FPIA-3000 particle characterization analyzer, manufactured by Malvern Instruments, Ltd., Malvern, Worcestershire UK.

Control Toner

The Example Polyester Resin Emulsion A and the Example Polyester Resin Emulsion B are used in a core to shell ratio of 65:35 (wt.). Components were added to a 2.0 liter reactor in the following relative proportions: 538 g (29.75%) of the Example Polyester Resin Emulsion A, 60.5 g (29.17%) of the Example Cyan Pigment Dispersion, 98 g (35%) of the Example Wax Emulsion. Deionized water was then added so that the mixture contained about 12% to about 15% solids by weight.

The mixture was heated in the reactor to 25° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 210 g of 1% sulfuric acid solution. The flow of the loop was then reversed to return the toner mixture to the reactor and the temperature of the reactor was increased to about 40-45° C. Once the particle size reached 4.05 μm to 4.5 μm (number average), 5% (wt.) borax solution (20 g of solution having 1.0 g of borax) was added. After the addition of borax, 290 g (29.75%) of the Example Polyester Resin Emulsion B was added to form the shell. The mixture was stirred for about 5 minutes and the pH was monitored. Once the particle size reached 5.5 μm (number average), 4% NaOH was added to raise the pH to about 6.89 to stop the particle growth. The reaction temperature was held for one hour. The temperature was increased to 82° C. to cause the particles to coalesce. This temperature was maintained until the particles reached their desired circularity. The final toner had a volume average particle size of 6.45 μm, and a number average particle size of 5.37 μm. Fines (<2 μm) were present at 7.20% (by number) and the toner possessed a circularity of 0.976.

Test Results

Churn Test and Dusting Results

One of the factors affecting toner dusting is the toner charge. If the charge is not maintained at an adequate level, the toner particles become susceptible to forces exerted by electric fields, and thus more readily become suspended in air. Since the charge exchange between toner particles and magnetic carrier particles is moderated by the moisture content in the air, one measure of toner performance is the ability to maintain adequate toner tribocharge, particularly at high humidity environments. Toner charge can also diminish when the developer mix is not being stirred in a toner reservoir. Each toner formulation was mixed with magnetic carrier particles to create a developer mix. The developer mix contained 8% of toner by mass, and the remainder (92%) of magnetic carrier particles. The toner and carrier were combined in a blender for sufficient time to assure good distribution of the toner onto the surfaces of the carrier particles. A total of ~290 grams of the developer mix was then loaded into a toning station, and placed into a test fixture which simulated the operation of a developer unit in an electrophotographic printer, by means of a drive motor which rotated at the same speed as motors in the printer. The test fixture was placed in a test chamber, at 78° F. and 80% relative humidity to increase any tendency of the toner to dust. The toner tribocharge was measured initially, once again after the toning station had been operated for a time period that simulated the processing of 10,000 sheets, and for a final time after leaving the developer mix in the toning station overnight in the test chamber after processing the 10,000 sheets. The toner tribocharge was measured in an Epping q/m meter based on a known toner mass. The tribocharge results are shown in Table 1.

Toner dust was evaluated using a paper strip placed over the mouth of the developer roll in the toning station. The motor used to rotate the toning station was operated for 20 seconds while the paper strip was in place to cause any dust coming from the developer unit during operation to deposit onto the paper surface. Then the paper strip was removed and inspected. Dusting strips were visually evaluated and then measured for a change in paper darkness using a spectrophotometer to measure print lightness (L*). The spectrophotometer results are shown in Table 1. Lower L* values indicate a darker paper strip due to more visible dusting on the strip. A clean or unused paper strip has a measured L* value of 96. Values below 90 produce a visually noticeable "band" of toner along the length of the paper strip. This is not a desirable result. Toner dust affects print quality and also can negatively affect the life of other components within an electrophotographic printer. A visual inspection of the amount of dusting on the hardware components in the toning station was observed at 0, 1,000, 5,000 and 10,000 simulated sheet intervals, and the results are reported in Table 2.

TABLE 1

| | Toner charge, Qt (μC/g) | | | 0-10,000 | Overnight | Dusting Strip (L*) | |
|---|---|---|---|---|---|---|---|
| | 0 | 10,000 | 10,000 (overnight) | ΔQt (μC/g) | ΔQt (μC/g) | 10,000 | 10,000 (overnight) |
| Example Toner A | −65.47 | −41.21 | −28.48 | 24.26 | 12.73 | 96.4 | 94.8 |
| Control Toner | −48.10 | −35.45 | −16.87 | 12.65 | 18.58 | 90.5 | 52.6 |

TABLE 2

| | Toner Station Dusting Rating | | | |
|---|---|---|---|---|
| Simulated sheets | 0 | 1,000 | 5,000 | 10,000 |
| Example Toner A | | Very light | Light | Light |
| Control Toner | — | Light | Light to Moderate | Moderate |

As shown in Table 1, the Control Toner exhibited lower tribocharge levels than Example Toner A, both initially and during simulated processing, even though the loss in tribocharge for 10,000 simulated sheets was greater for the Example Toner A. More importantly, the silane treated Example Toner A exhibited less tribocharge loss compared to the Control Toner after being left overnight $-\Delta Qt$ was 12.73 (μC/g). As previously mentioned, the toner tribocharge diminishes when the developer mix is at rest, and accordingly, minimizing this loss is desirable.

This retention of tribocharge when the developer mix is at rest corresponds to the significantly less dust on the paper strip for Example Toner A as compared to the Control Toner. After 10,000 simulated pages, Example Toner A had practically no dusting compared to the Control Toner which had a visible deposit of toner on the paper strip. After being left overnight, the Example A Toner had a very light deposit of toner on the strip, but the Control Toner had deposited a significant amount of toner onto the paper strip, as shown by a very low L* value of 52.6.

As shown in Table 2, Example Toner A also performed better and exhibited less dusting on hardware components than the Control Toner. While the Control Toner already exhibited Moderate dusting after 10K pages, the Example Toner A only exhibited Light to Moderate dusting. This is desirable as it would mean less interference on other printer components due to toner dust.

The foregoing description of several embodiments of the present disclosure has been presented for purposes of illustration. It is not intended to be exhaustive or to limit the present disclosure to the precise forms disclosed, and obviously many modifications and variations are possible in light of the above teaching. It is intended that the scope of the present disclosure be defined by the claims appended hereto.

What is claimed is:

1. A chemically prepared toner composition, comprising:

a core having an outer surface, the core having components including a first polymer binder, a colorant and a release agent;

a borax coupling agent located on the outer surface of the core;

a shell formed around the outer surface of the core and the borax coupling agent, the shell including a second polymer binder, wherein the core, the borax coupling agent and the shell form a toner particle having an outer surface; and 1,3-di-n-octyltetramethyldisiloxane and diethoxydimethylsilane located on the outer surface of the toner particle, wherein alkoxy groups found in the 1,3-di-n-octyltetramethyldisiloxane and the diethoxydimethylsilane covalently bond with functional groups located on the outer surface of the toner particle.

2. The chemically prepared toner of claim 1, wherein the first polymer binder and the second polymer binder each include a polyester resin.

3. The chemically prepared toner of claim 1, wherein the first polymer binder and the second polymer binder each include a styrene polymer.

4. A chemically prepared toner composition, comprising:

a core having an outer surface, the core having components including a first polymer binder, a colorant and a release agent;

a borax coupling agent located on the outer surface of the core;

a shell formed around the outer surface of the core and the borax coupling agent, the shell including a second polymer binder, wherein the core, the borax coupling agent, and the shell form a toner particle having an outer surface; and n-octadecyltrimethoxysilane located on the outer surface of the toner particle, wherein alkoxy groups found in the n-octadecyltrimethoxysilane covalently bond with functional groups located on the outer surface of the toner particle.

* * * * *